US009179758B2

(12) United States Patent
Calilung et al.

(10) Patent No.: US 9,179,758 B2
(45) Date of Patent: Nov. 10, 2015

(54) CHILD CARRIERS AND METHODS FOR OPERATING THE SAME

(75) Inventors: Ryan Calilung, Chicago, IL (US); Peter J. Myers, Wheaton, IL (US); Trisha Kramer, Montgomery, IL (US); Chris Ryan, Chicago, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 2999 days.

(21) Appl. No.: 11/303,310

(22) Filed: Dec. 16, 2005

(65) Prior Publication Data

US 2007/0138218 A1 Jun. 21, 2007

(51) Int. Cl.

| | |
|---|---|
| ***A61G 1/00*** | (2006.01) |
| ***A45F 3/04*** | (2006.01) |
| ***A45F 3/08*** | (2006.01) |
| ***A47D 13/02*** | (2006.01) |

(52) U.S. Cl.

CPC ..... *A45F 3/08* (2013.01); *A47D 13/025* (2013.01)

(58) Field of Classification Search

CPC ..... A45F 3/08; A47D 13/025
USPC ..... 224/158–161, 578–579; 24/609–611, 24/702

See application file for complete search history.

(56) References Cited

U.S. PATENT DOCUMENTS

| | | | | |
|---|---|---|---|---|
| 484,065 A | | 10/1892 | Taylor | |
| 2,599,474 A | | 2/1950 | Mills | |
| 2,554,340 A | * | 5/1951 | Huppe | 294/140 |
| 3,229,873 A | | 1/1966 | Hershman | |
| 3,451,720 A | * | 6/1969 | Makinen | 297/483 |
| 4,149,687 A | | 4/1979 | Nunemacher | |
| 4,234,229 A | | 11/1980 | Arnold | |
| 4,271,998 A | | 6/1981 | Ruggiano | |
| 4,428,514 A | * | 1/1984 | Elf | 224/579 |
| 4,434,920 A | | 3/1984 | Moore | |
| 4,467,945 A | | 8/1984 | Schaapveld | |

(Continued)

FOREIGN PATENT DOCUMENTS

| | | |
|---|---|---|
| GB | 2224635 | 10/1989 |
| WO | 8404445 | 5/1984 |

(Continued)

OTHER PUBLICATIONS

BABYJORN Baby Carrier Original, 4 pages, date unknown.

(Continued)

*Primary Examiner* — Adam Waggenspack
(74) *Attorney, Agent, or Firm* — Hanley, Flight and Zimmerman, LLC

(57) ABSTRACT

Child carriers and methods for operating the same are disclosed. An example child carrier includes a child support pouch to receive a child in a substantially upright position and a harness to support the child support pouch on an adult. The harness includes first and second support straps, first and second waist straps, and first and second support strap connector pairs. The first support strap connector pair is located to releasably connect the first support strap to the first waist strap in a first orientation with the first support strap across a shoulder of the adult and to releasably connect the first support strap to the first waist strap in a second orientation with the first support strap around a waist of the adult. The second support strap connector pair is located to releasably connect the second support strap to the second waist strap.

31 Claims, 8 Drawing Sheets

(56) References Cited

U.S. PATENT DOCUMENTS

| | | | | |
|---|---|---|---|---|
| 4,724,988 | A | 2/1988 | Tucker | |
| D294,429 | S | 3/1988 | Vasquez | |
| 4,903,873 | A | 2/1990 | Poole et al. | |
| 4,986,458 | A | 1/1991 | Linday | |
| 4,993,612 | A | 2/1991 | Quimby, Sr. et al. | |
| 5,011,057 | A | 4/1991 | Perruzza et al. | |
| 5,071,047 | A | 12/1991 | Cordisco | |
| 5,178,309 | A | 1/1993 | Bicheler et al. | |
| 5,205,450 | A | 4/1993 | Derosier | |
| 5,205,451 | A | 4/1993 | Manzer | |
| 5,222,641 | A | 6/1993 | Medeiros, Jr. | |
| 5,246,152 | A | 9/1993 | Dotseth | |
| 5,346,152 | A | 9/1994 | Föhl | |
| 5,361,952 | A | 11/1994 | Gold | |
| D357,800 | S | 5/1995 | Roan et al. | |
| 5,437,403 | A | 8/1995 | Lemanski, II | |
| 5,490,620 | A | 2/1996 | Bergqvist | |
| 5,492,256 | A | 2/1996 | Ive | |
| D370,996 | S | 6/1996 | Shimura et al. | |
| 5,522,528 | A | 6/1996 | Petricola | |
| 5,549,356 | A * | 8/1996 | Gray | 297/256.15 |
| 5,570,823 | A | 11/1996 | Lindy | |
| D377,116 | S | 1/1997 | Shimura et al. | |
| D378,872 | S | 4/1997 | Shimura et al. | |
| D385,105 | S | 10/1997 | Fair | |
| 5,673,828 | A | 10/1997 | Raedel et al. | |
| 5,678,739 | A | 10/1997 | Darling et al. | |
| 5,690,258 | A | 11/1997 | Kataoka | |
| D388,247 | S | 12/1997 | McLauchlan | |
| 5,692,655 | A | 12/1997 | Fair et al. | |
| 5,732,861 | A | 3/1998 | Jakobson | |
| 5,772,088 | A | 6/1998 | Nelson | |
| 5,791,535 | A | 8/1998 | Roan et al. | |
| D397,867 | S | 9/1998 | Fair et al. | |
| 5,813,580 | A | 9/1998 | Fair | |
| 5,848,741 | A | 12/1998 | Fair | |
| D409,373 | S | 5/1999 | Fair et al. | |
| D414,032 | S | 9/1999 | Howell | |
| 5,950,896 | A | 9/1999 | Theodore | |
| 6,009,839 | A | 1/2000 | Kohn | |
| 6,023,820 | A | 2/2000 | Fair | |
| 6,045,018 | A | 4/2000 | Onishi | |
| D425,696 | S | 5/2000 | Swanke | |
| 6,073,820 | A | 6/2000 | Drobinski | |
| 6,079,744 | A * | 6/2000 | Husby et al. | 280/801.1 |
| D437,996 | S | 2/2001 | Fair et al. | |
| 6,182,873 | B1 | 2/2001 | Christopher et al. | |
| 6,257,468 | B1 | 7/2001 | Yamazoe et al. | |
| 6,325,259 | B1 | 12/2001 | Tharalson et al. | |
| 6,328,386 | B1 * | 12/2001 | Good | 297/483 |
| D452,993 | S | 1/2002 | Norman | |
| D453,066 | S | 1/2002 | Norman | |
| D455,546 | S | 4/2002 | Norman | |
| 6,398,088 | B1 | 6/2002 | Burke | |
| 6,481,606 | B2 | 11/2002 | Pickett | |
| 6,520,391 | B2 | 2/2003 | Yen | |
| 6,595,396 | B2 | 7/2003 | Cummings et al. | |
| 6,598,771 | B2 | 7/2003 | Norman | |
| 6,666,361 | B1 * | 12/2003 | Lin | 224/160 |
| 6,672,493 | B1 | 1/2004 | Fair et al. | |
| 6,736,299 | B2 | 5/2004 | Bergkvist | |
| 6,763,983 | B2 | 7/2004 | Norman | |
| 6,866,174 | B2 | 3/2005 | Hiscocks | |
| D507,102 | S | 7/2005 | Bergkvist et al. | |
| D507,869 | S | 8/2005 | Liistro et al. | |
| D509,056 | S | 9/2005 | Shiraishi et al. | |
| 2003/0047573 | A1 | 3/2003 | Bergkvist | |
| 2003/0071511 | A1 | 4/2003 | Stafford et al. | |
| 2004/0016780 | A1 | 1/2004 | Cummings et al. | |
| 2004/0020951 | A1 | 2/2004 | Bergkvist | |
| 2004/0094922 | A1 | 5/2004 | Eros | |
| 2004/0094923 | A1 * | 5/2004 | Eros et al. | 280/47.38 |
| 2004/0238579 | A1 | 12/2004 | Krogh | |
| 2005/0071962 | A1 | 4/2005 | Bergkvist | |
| 2005/0077331 | A1 | 4/2005 | Keller et al. | |
| 2005/0155995 | A1 | 7/2005 | Lee | |
| 2005/0155996 | A1 | 7/2005 | Hiscocks | |
| 2005/0184114 | A1 | 8/2005 | Hoff et al. | |
| 2005/0236451 | A1 | 10/2005 | Juhlin | |
| 2005/0279785 | A1 | 12/2005 | Liistro et al. | |
| 2006/0000002 | A1 | 1/2006 | Bergkvist | |

FOREIGN PATENT DOCUMENTS

| | | |
|---|---|---|
| WO | 03/003880 | 6/2003 |
| WO | 2004/049875 | 6/2004 |
| WO | 2004/049876 | 6/2004 |

OTHER PUBLICATIONS

Evenflo Company, Inc., Snugli—Cross Country Backpack Child Carrier, Sep. 2002, 19 pages.

Evenflo Company, Inc., "Snugli—Classic Soft Carrier," Jun. 2003, 9 pages.

Evenflo Company, Inc., "Snugli—Comfort Vent Soft Carrier," Jun. 2003, 9 pages.

Evenflo Company, Inc., "Snugli—Front and Back Pack Soft Carrier," Jun. 2003, 13 pages.

Evenflo Company, Inc., "Snugli—Cross Roads Backpack Child Carrier," Jun. 2003, 9 pages.

Evenflo Company, Inc., "Snugli—Cross Terrain Backpack Child Carrier," Jun. 2003, 11 pages.

Evenflo Company, Inc., "Snugli—Nicole Miller Soft Carrier," Oct. 2003, 9 pages.

Evenflo Company, Inc., "Snugli—City Sport FBP Front and Back Pack Soft Carrier," Aug. 2004, 11 pages.

* cited by examiner

CHILD CARRIERS AND METHODS FOR OPERATING THE SAME

FIELD OF THE DISCLOSURE

This disclosure relates generally to child carrying devices, and, more particularly, to child carrying devices that are worn on an adult and methods of operating the same.

BACKGROUND

Conventional child carriers are used by adults to carry infants and young children. Child carriers are structured so that the child is fastened securely in the carrier, which in turn is fastened securely to the wearer, thus freeing the arms and hands of the wearer from the burdens of directly providing support to the child and not having free hands. The use of a child carrier allows parents or other adults to carry a child close to them, to be free from having to push around a stroller or awkwardly carry a car seat at their side, and to have their hands free to carry other objects or perform other functions.

Known child carriers include back child carriers and front child carriers. Back child carriers carry the child in a child-support pouch on the back of an adult. Front child carriers carry the child in a child-support pouch on the front of the adult. Some child-support pouches allow the child to be carried facing forward (i.e., in the same direction as the adult when the carrier is worn on the chest of the adult), and some child-support pouches allow the child to be carried facing rearward (i.e., facing towards the adult when the carrier is worn on the chest of the adult).

Typical front child carriers have a shoulder harness that has left and right shoulder straps which go over, respectively, the left and right shoulders of the adult who is carrying the child. Some child carriers have an additional strap in the form of a waist belt. The shoulder straps have ends which are attached to the child support pouch. It is also common for the left shoulder strap to extend from the upper left side to the lower right side of the pouch and the right shoulder strap to extend from the upper right side to the lower left side of the pouch where the one strap crosses over the other strap at the back of the adult wearing the front child carrier. The shoulder straps may be adjusted by changing a snap-attachment location of the shoulder straps to the pouch or by changing the working length of the shoulder straps using a buckle structure.

In many typical designs, as the wearer assembles the child carrier, the child is placed in the carrier and then the child support pouch is attached to the shoulder straps via a typical male/female connection wherein a "male" piece is inserted into a "female" piece. However, other connections such as, for example, ties and snaps may be used as well. Many times, the wearer or other person assembling the child carrier may be rushed, overwhelmed with other children, luggage or background noise and commotion, and unable to either hear the male and female connectors click into place or otherwise fail to determine that the male and female connectors are not fully mated, which can be very dangerous. Because child carriers are used to carry children, including fragile infants, it is extremely important that the connectors coupling the child support pouch to shoulder straps, e.g., the male/female connections are secure. If a connection were to become loose, the child support pouch could disassociate from the shoulder straps and open up, which could result in the child being carried therein to fall from the pouch and become injured.

In many typical designs, the child support pouch includes a front, bottom and back. The front of the support pouch is the portion that faces outwards when the wearer is wearing the child carrier on his or her chest. Thus, the front portion may cover the back or chest of the child placed therein, depending upon the orientation of the child. The bottom portion covers and supports the bottom of the child and, consequently, the majority of the weight of the child. The back portion of the child support pouch is positioned between the adult wearer and the carried child, and covers the back or chest of the child, again depending on the orientation of the child situated therein. Often the child support pouches are sized large enough to also cover a substantial portion of the head and/or arms of the child carried therein. Because so much of the child is engulfed in the child support pouch, the temperature in the interior of the pouch may be substantially higher than the temperature exterior to the pouch. Further, moisture may develop within the child support pouch due to the increased temperature and/or from a leaky diaper. Both the increased temperature and the moisture may create an unpleasant environment in the child support pouch.

DETAILED DESCRIPTION

Figure 1:
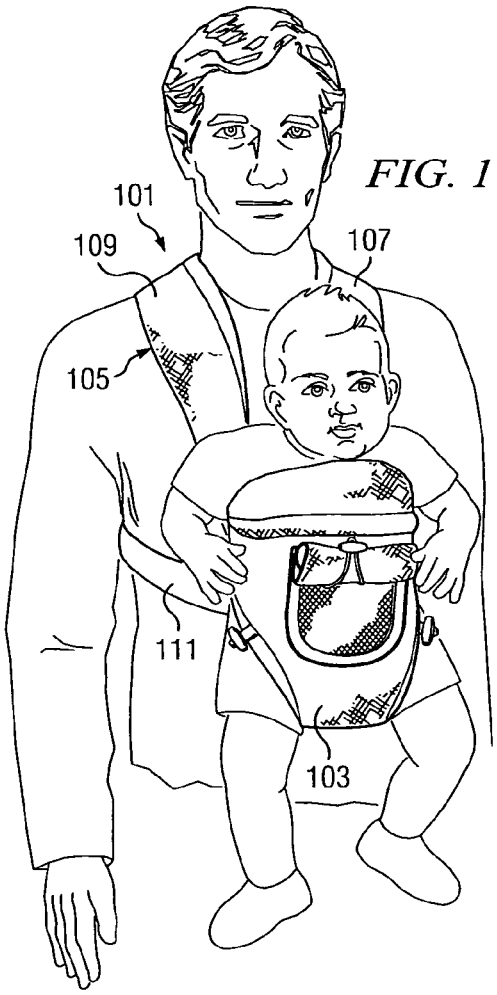
FIG. 1 is front view of an example child carrier shown worn over both shoulders of a wearer.
Figure 2:
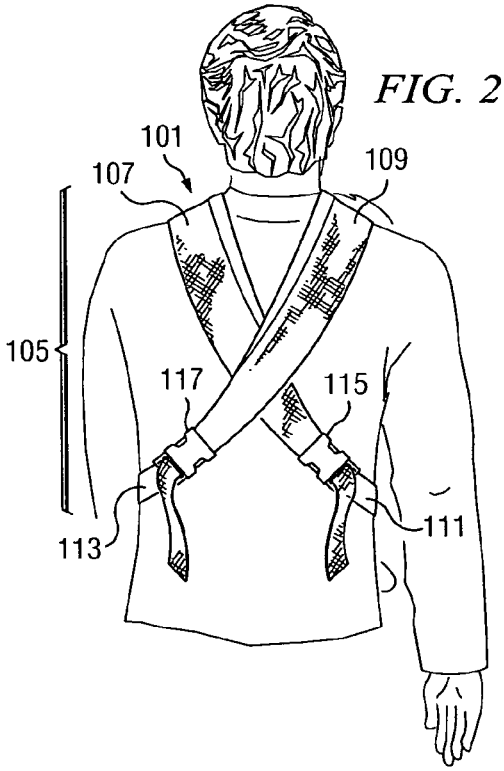
FIG. 2 is a rear view of the carrier as shown in FIG. 1.

FIGS. 1-5 illustrate an example child carrier 101 constructed in accordance with the teachings of invention. The child carrier 101 of the illustrated example includes a child support pouch 103 to receive a child in a substantially upright position and a harness 105 to support the child support pouch 103 on an adult. In the illustrated example, the harness 105 includes first and second support straps 107, 109, first and second waist straps 111, 113, and first and second support strap connector pairs 115, 117. The first support strap connector pair 115 may be located to releasably connect the first support strap 107 to the first waist strap 111 in a first orientation with the first support strap 107 across a shoulder of the adult such that the child support pouch 103 is located on the chest of the adult wearing the harness 105 (FIGS. 1 and 2).

Figure 3:
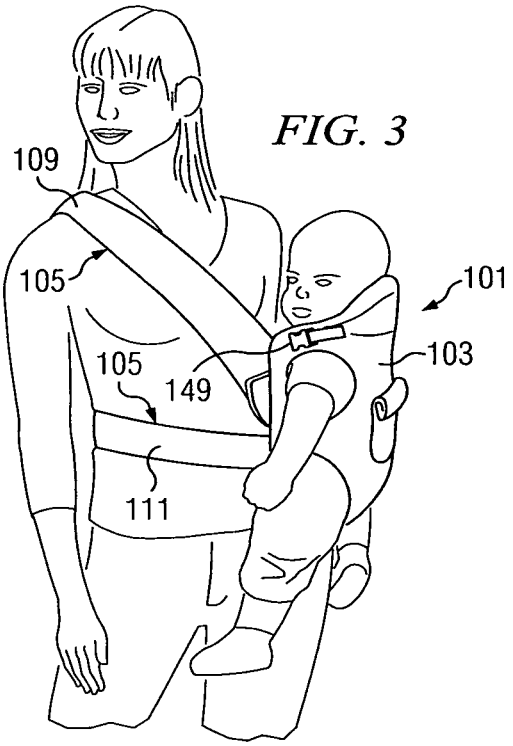
FIG. 3 is a front view of the carrier of FIG. 1 shown worn over one shoulder and around the waist of a wearer.
Figure 4:
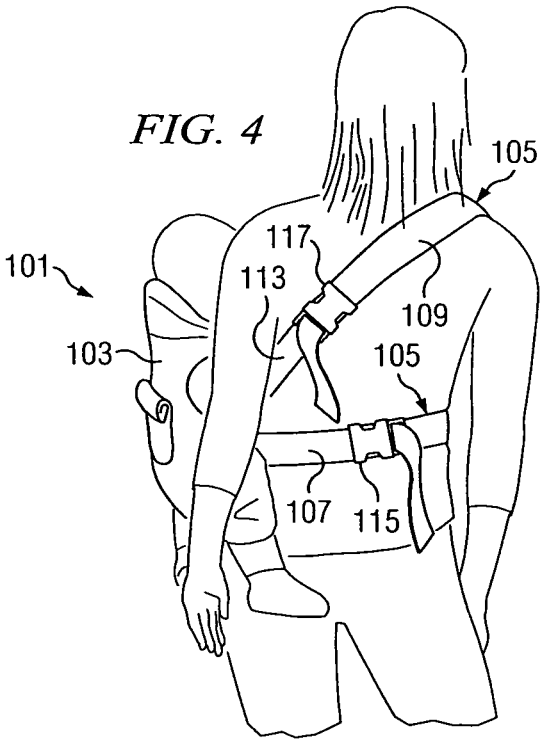
FIG. 4 is a rear view of the carrier as shown in FIG. 3.

The first support strap connector pair 115 may also be located to releasably connect the first support strap 107 to the first waist strap 111 in a second orientation with the first support strap 107 around a waist of the adult such that the child support pouch 103 is located on a hip of the adult wearing the harness 105 (FIGS. 3 and 4). Similarly, the second support strap connector pair 117 is located to releasably connect the second support strap 109 to the second waist strap 113. The second support strap 109 and the second waist strap 113 may be connected in a first orientation with the second support strap 109 across a shoulder of the adult such that the child support pouch 103 is located on the chest of the adult wearing the harness 105 or in a second orientation with the second support strap 109 across the waist of the adult such that the child support pouch is located on a hip of the adult wearing the harness 105.

Preferably at least one of the support straps 107, 109 is located across a shoulder of the adult at all times. In other words, the first support strap 107 and the second support strap 109 should not both be in the second orientation. Any other orientation combination (e.g., first support strap 107 in the first orientation and second support strap 109 also in the first orientation, first support strap 107 in the first orientation while the second support strap 109 is in the second orientation, or first support strap 107 in the second orientation while the second support strap is in the first orientation) are permissible to enable the child support pouch 103 to be located in the right hip, left hip or chest of the adult wearer.

Figure 5:
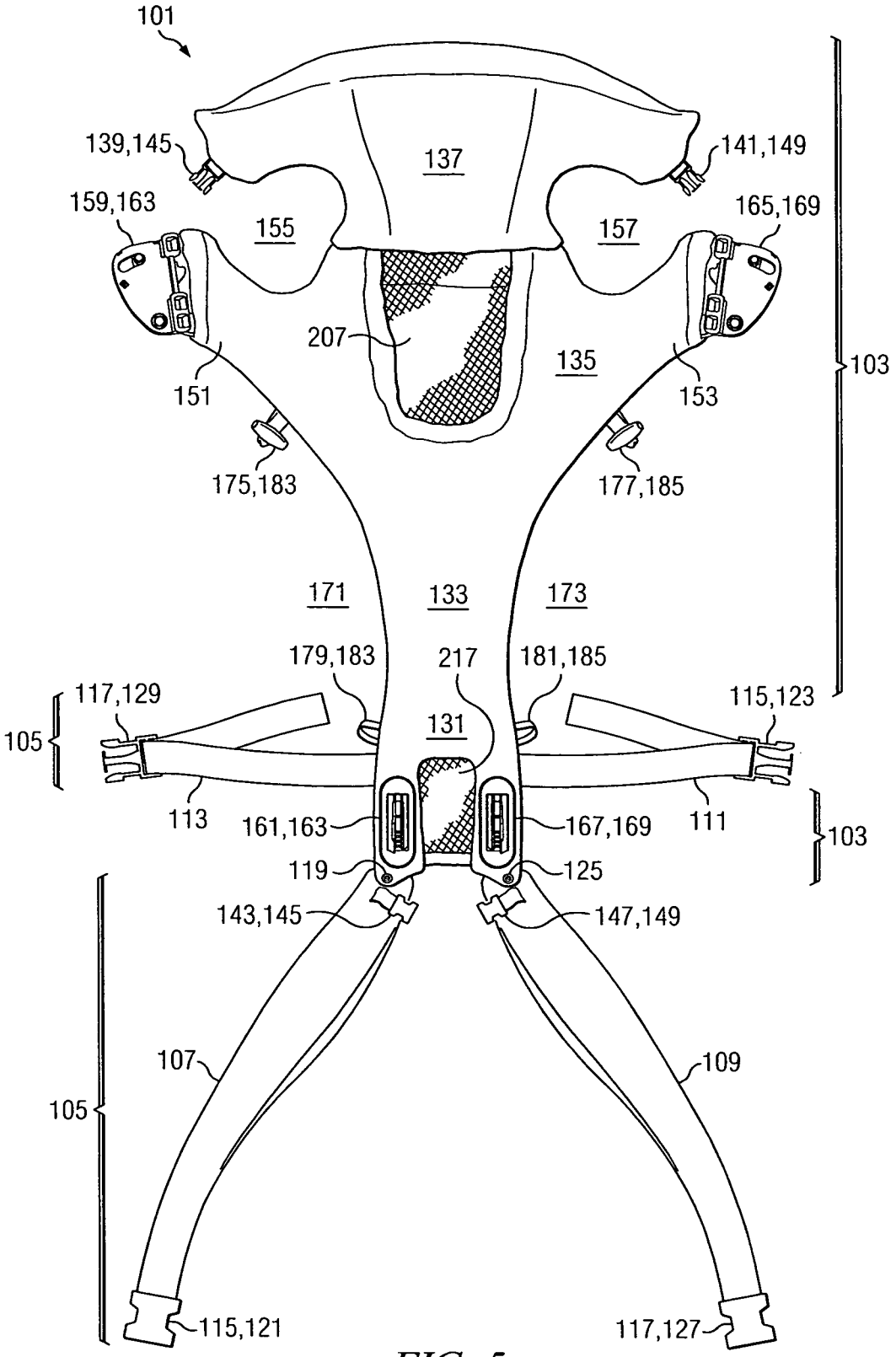
FIG. 5 is a plan view of the carrier of FIG. 1 shown fully expanded in an unworn state.

One or more of the straps 107, 109, 111, 113 is preferably adjustable to adjust to the comfort or size of the wearer. For example, as shown in FIG. 5, the first waist strap 111 is threaded through a first male harness connector 123. The first male harness connector 123 may be moved to any location along the first waist strap 111. The closer the first male harness connector is located to the child support pouch 103, the shorter the working length of the first waist strap 111 becomes, i.e., the tighter the first waist strap 111 will fit the adult wearer. Similarly, the second waist strap 113 is threaded through a second male harness connector 129. The second male harness connector 129 may be moved along the second waist strap 113 in a similar manner as the first male connector 123 is adjusted along the first waist strap 111, with similar results. Furthermore, the shoulder straps 107, 109 are adjustable in a similar fashion by movement of a first female harness connector 121 and a second female harness connector 127 to shorten or length the first shoulder support strap 107 and second shoulder support strap 109, respectively. Though the illustrated example shows male harness connectors 123, 129 on the waist straps 111, 113 and female harness connectors 121, 129 on the shoulder straps 107, 109, any combination of harness connectors 121, 123, 127, 129 and straps 107, 109, 111, 113 described herein may be used. Furthermore, though the straps 107, 109, 111, 113 are adjustable through movements of the harness connectors 121, 123, 127 and 129, the straps 107, 109, 111, 113 may be adjusted by any other mechanical means such as, for example, snaps, clips or ties.

In the illustrated example, the first support strap 107 is connected at one end to the child support pouch 103 via a first pivot 119 (FIG. 5). The pivot may be implemented, for example, by a rivet or other mechanical fastener. The opposite end of the first support strap 107 of the illustrated example is connected to the first female harness connector 121. The first waist strap 111 of the illustrated example is connected at one end to the child support pouch 103 and is coupled to the first male harness connector 123 either at the other end or along the length of the first waist strap 111. The female and male connectors 121, 123 mate to form the first support strap connector pair 115. Similarly, the second support strap 109 of the illustrated example is connected at one end to the child support pouch 103 via a second pivot 125. The pivot may be implemented, for example, by a rivet or other mechanical fastener. The opposite end of the second support strap 109 of the illustrated example is connected to the second female harness connector 127. The second waist strap 113 of the illustrated example is connected at one end to the child support pouch 103 and is coupled to the second female harness connector 129 either at the other end of along the length of the second waist strap 113. The female and male connectors 127, 129 mate to form the second support strap connector pair 117. If convertibility is not desired (i.e., if it is desired to limit the carrier 101 to use as a front carrier), the first and second support straps 107, 109 and/or the first and second waist straps 11, 113 may be threaded through or otherwise coupled to a four-way buckle (not shown), which would, for example, be located near the center of the back of the user to hold the straps 107, 109, 111, 113 in a substantially immobile relation to one another.

Though the first female harness connector 121 is coupled to the first support strap 107, and the first male harness connector 123 is coupled to the first waist strap 111, the connectors 121, 123 may be switched and the first female harness connector 121 may be coupled to the first waist strap 111 and the first male harness connector 123 may be coupled to the first support strap 107. Similarly, though the second female harness connector 127 is coupled to the second support strap 109, and the second male harness connector 129 is coupled to the second waist strap 113, the connectors 127, 129 may be switched and the second female harness connector 127 may be coupled to the second waist strap 113 and the second male harness connector 129 may be coupled to the first support strap 109. Reversing the locations of the first female harness connector 121 and the first male harness connector 123 without changing the location of the second female harness connector 127 and second male harness connector 129 or reversing the second female harness connector 127 and second male harness connector 129 without changing the location of the first female harness connector 121 and the first male harness connector 123 (i.e., the first and second female harness connectors 121, 127 are not both coupled to the first and second support straps 107, 109) provides a configuration where the first support strap 107 will connect with the first waist strap 111 but cannot be mistakenly connected to the second waist strap 113, and where the second support strap 109 will connect with the second waist strap 113 but cannot be mistakenly connected to the first waist strap 111. Proper assembly of the child carrier 101 is, thus, ensured.

The example child support pouch 103 of the illustrated example includes a back portion 131, a bottom portion 133 and a front portion 135. In the example of FIG. 105, the back portion 131 is located to be positioned between a child that is in the child support pouch 103 and the wearer of the harness 105.

The bottom portion 133 of the illustrated example supports the child from below. In the example of FIGS. 1-5, the bottom portion 133 has a plurality of mechanical fasteners (not shown) such as a zipper with a plurality of generally parallel zipper teeth runs such that the zipper can be closed using different pairs of the runs to bunch or fold the bottom 133 to effectively shorten or lengthen the same. However, any type of mechanical fastener can be used to adjust the length of the bottom portion 133. Shortening the length of the bottom portion 133 decreases the volume of the child support pouch 103, which can be done to more securely fit a smaller child. Likewise, increasing the length of the bottom portion 133 increases the volume of the child support pouch 103, which can be done to accommodate the size of an older or larger child.

In the illustrated example, the front portion 135 of the pouch 103 faces outwards, away from the body of the adult wearer. In the illustrated example, a headrest 137 is coupled to the front portion 135 of the pouch 103. FIGS. 3 and 4 show the headrest 137 in a use or support position. As shown in FIG. 5, the headrest 137 is attached to a first male headrest connector 139 and a second male headrest connector 141. The first male headrest connector 139 may be coupled to a first female headrest connector 143, which may be located on the first support strap 107 or the back portion 131 of the child support pouch 103 to form a first headrest connector pair 145. Likewise, the second male headrest connector 141 may be coupled to a second female headrest connector 147, which may be located on the second support strap 109 or the back portion 131 of the child support pouch 103 to form a second headrest connector pair 149. The first and second headrest connector pairs 145, 149 may be used to couple the headrest 137 to the harness 105, the back portion 131 of the child support pouch 103, the first support strap 107 and/or the second support strap 109. Though the illustrated example shows the first and second male headrest connectors 139, 141 coupled to the headrest 137 and the first and second female headrest connectors 143, 147 coupled to first and second support straps 107, 109, respectively, either or both of the first and second female headrest connectors 143, 147 may be coupled to the headrest 137 and either or both of the first and second male headrest connectors 139, 141 may be respectively coupled to the first and second support straps 107, 109 or to the back portion 131.

Furthermore, when the first and second headrest connection pairs 145, 149 are engaged, the headrest 137 is in a support position such that the headrest 137 will support the head of the child carried in the child carrier 101 (See FIG. 3). FIG. 1 shows the headrest 137 after it has been moved out of the support position and folded down into a storage position. In this storage position, the headrest connector pairs 145, 149 may be disengaged or engaged in positions 180° from the position noted above.

Returning to FIG. 5, in the illustrated example, the front portion 135 of the child support pouch 103 has a first wing 151 and a second wing 153. When the first headrest connector pair 145 is engaged, the first wing 151 cooperates with the headrest 137 to form a first arm opening 155. Similarly, when the second headrest connector pair 149 is engaged, the second wing 153 cooperates with the headrest 137 for form a second arm opening 157. The arm openings 155, 157 enable the passage of the arms of the child support pouch 103, which may increase the child's comfort (See FIG. 3).

In the illustrated example, the first wing 151 is coupled to a first child support connector 159 that mates with a second child support connector 161, which is located on the back portion 131, to form a first fastener or child support strap connector pair 163. Similarly, in the example of FIGS. 1-5, the second wing 153 is coupled to a third child support connector 165 that mates with a fourth child support connector 167, which is located on the back portion 131 to form a second fastener or child support strap connector pair 169. When the first child support connector 159 is coupled to the second child support connector 161 to form the fastener 163 and the third child support connector 165 is coupled to the fourth child support connector 167 to form the fastener 169, the front portion 135 substantially opposes the back portion 131 to form the child support pouch 103. In the illustrated example, the first, second, third, and fourth child support connectors 159, 161, 165, 167 are coupled to the child support pouch 103 via any known mechanical or chemical fastener, e.g., (thread, glue, rivets, etc.).

When the fasteners 163, 169 are formed, the front portion 135, the bottom portion 133 and the back portion 131 cooperate to form a first leg opening 171 and a second leg opening 173. Similar to the arm openings 155, 157, the leg openings 171, 173 enable the passage of the legs of the child to the exterior of the child support pouch 103, which increases the child's comfort and prevents the child from using his or her legs to stand within the pouch 103 (FIGS. 1 and 3). The front portion 135 of the illustrated example pouch 103 includes a first toggle 175 and a second toggle 177. The back portion 131 of the example pouch 103 includes a first loop 179 and a second loop 181. The first toggle 175 and first loop 179 form a first leg opening connector 183, and the second toggle 177 and second loop 181 form a second leg opening connector 185. When the leg opening connectors 183, 185 are engaged, the leg openings 171, 173 are reduced in size. Reducing or enlarging the size of the leg openings 171, 173 ensures a secure fit for a variety of differently-sized children. Though in the illustrated example toggles 177, 179 and loops 179, 181 are shown, the leg opening connectors 183, 185 may be formed from any type of mechanical fastener, e.g., Velcro® strips, snaps, buttons, pins, etc. Furthermore, one or both of the loops 179, 181 may be coupled to the first support strap 107 and/or the second support strap 109 instead of the back portion 131. Further, the respective positions of one or both pairs of the toggles 177, 179 and loops 179, 181 may be reversed.

As shown in FIGS. 1-4, the child carrier 101 may be worn such that the child support pouch 103 is located adjacent the chest of an adult wearer when the first support strap 107 and the second support strap 109 are positioned in a first orientation over the left and right shoulders of the wearer (FIGS. 1 and 2). Additionally, the child carrier 101 may be worn such that the child support pouch 103 is located adjacent to either side of an adult wearer when the first supporting strap 107 is positioned in a second orientation over one of the wearer's shoulders and across the wearer's chest, and the second support strap 109 is positioned in a second orientation around the wearer's waist (FIGS. 3 and 4) or vice versa. The conversion from the first orientation of FIGS. 1 and 2 (i.e., the front carry position) to the second orientation of FIGS. 3 and 4 (i.e., the hip carry position) may occur by disengaging one, both or neither of the first and second support strap connector pairs 115, 117. Further the conversion may occur while the child carrier 101 is being worn, it is recommended that a child not be disposed in the child support pouch 103 during the conversion.

To effect the conversion, the wearer of the child carrier 101 or other person detaches the first support strap 107 from the first waist strap 111, and thus disassembles the first support strap connector pair 115. Then the child support pouch 103 is moved from the front position to the hip position, and the first support strap 107 is moved from over the wearer's shoulder to around the wearer's waist. The first support strap 107 is moved about the first pivot 119 to effect this movement. Once the first support strap 107 is repositioned, the first support strap 107 is recoupled to the first waist strap 111. Further, the first support strap 107 and first waist strap 111 may be adjusted as needed. This conversion may also occur using the second support strap connector pair 117 and second pivot 125 but will result in the pouch 103 being positioned on the opposite hip than when the first strap connector pair 115 is converted. Further, to convert from either one of the hip positions to the front position, the opposite process is followed.

Figure 6A:
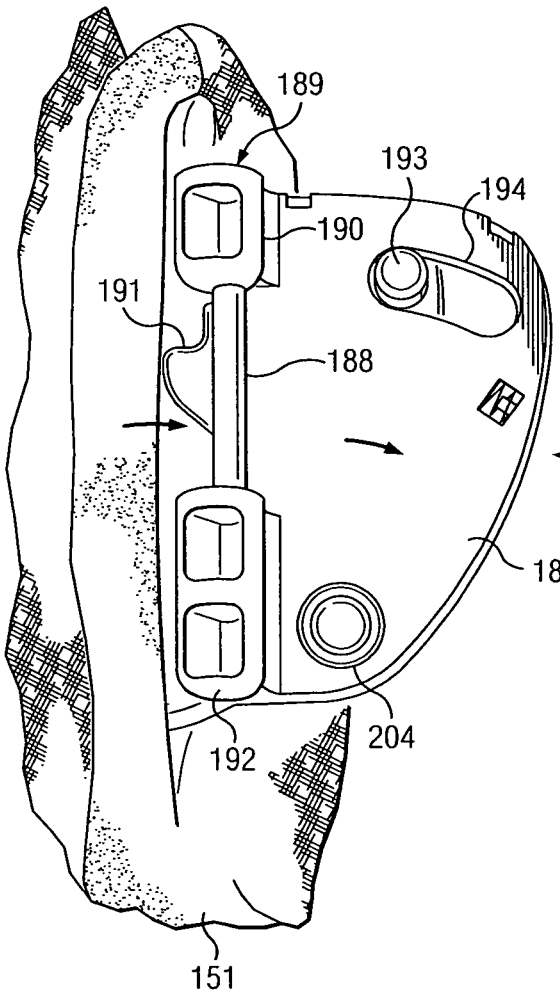
FIG. 6*a* is an enlarged bottom view of an example male child support connector.

An enlarged view of the example first child support connector 159 is shown in FIGS. 6*a, b* and 7. The example first child support connector 159 is a male connector that includes a grip 187 and a lug 189 extending from the grip 187. The illustrated grip 187 is a flat, quasi-semi-circular shape that can be easily gripped by the wearer or other person. Any other shape that maybe easily grasped and manipulated may alternatively be used. The lug 189 mates with an example second child support connector 161, as described in greater detail below. The illustrated lug 189 has enlarged ends 190, 192 to guide the first child support connector 159 to mate with the second child support connector 161 and a reduced middle section 188 between the ends 190, 192 to reduce the weight of the first child support connector 159. However, the lug 189 may be any shape to engage the second child support connector 161.

The grip 187 of the illustrated example serves as a housing to house a portion of a latch 191. The latch 191 is pivotable about a point 204 (FIG. 6*a, b*) between an over-locked position (FIGS. 6*a,b* and 7) and an unlocked or release position (not shown) with a locked or latched position intermediate the over-locked and released positions. In the illustrated example, the grip 187 also houses a spring 206 (FIG. 6*b*) that is seated between an inner surface of the grip 187 and a surface of the latch 191. The spring 206 biases the latch 191 toward the over-locked position. Further, a handle 193 extends through a window 194 defined in the grip 187 and through a slot 178 defined in the latch 191. The handle 193 is operatively coupled to the latch 191 to facilitate actuation of the latch 191 between the over-locked position and the unlocked position, as described in greater detail below. The handle 193 is preferably positioned where it can be easily actuated with the thumb of a hand holding the grip 187.

Figure 8:
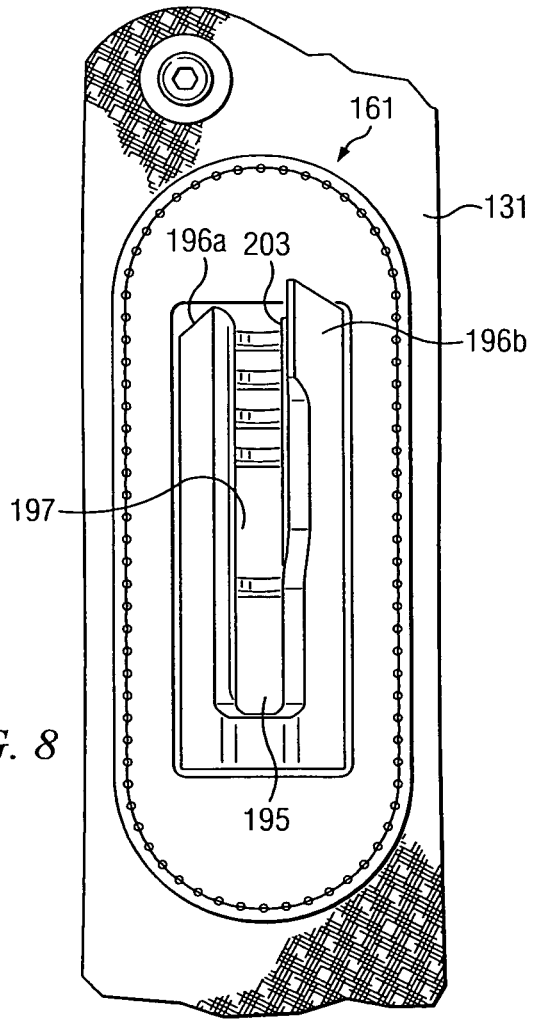
FIG. 8 is an enlarged plan view of an example female child support connector.

FIG. 8 shows an example second child support connector 161 in greater detail. In the example of FIG. 8, the second child support connector 161 is a female connector that includes a guide channel 195, which is configured to receive the lug 189 of the first child support connector 159. The guide channel 195 is defined by opposed walls 196*a,b* of the second child support connector 161. The second child support connector 161 also includes a receptacle 197 that may be an indentation formed in one of the walls 196*b* of the second child support connector 161. The receptacle 197 is positioned to mate with the latch 191 when the lug 189 is fully inserted in the channel 195 and the latch 191 is in the locked position to secure the first and second child support connectors 159, 161 in releasable engagement. A surface adjacent the receptacle 197 engages a surface of the latch 191 to hold the latch in the locked position between the over-locked position and the released position. In an alternative example, the latch 191 may be coupled to the second child support connector 161 and first child support connector 159 may include the receptacle 197. In the illustrated example of FIGS. 1-5, the third child support connector 165 is substantially the same the as the first child support connector 159, and the fourth child support connector 167 is substantially the same as the second child support connector 161.

Figure 10:
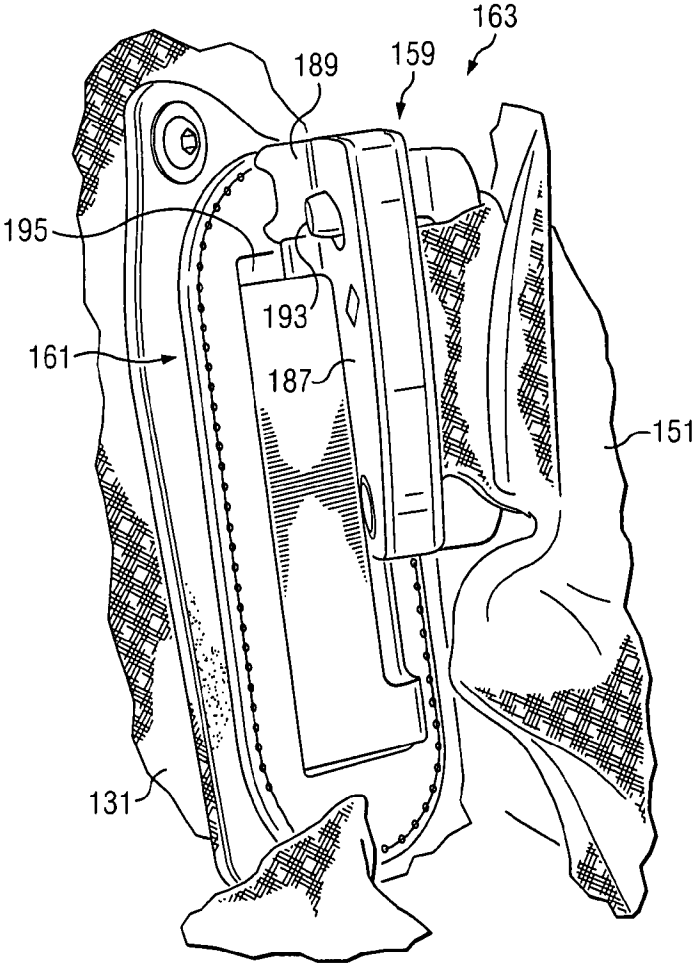
FIG. 10 is a side view of the male connector of FIG. 6*a* entering or exiting the female connector of FIG. 8.
Figure 9:
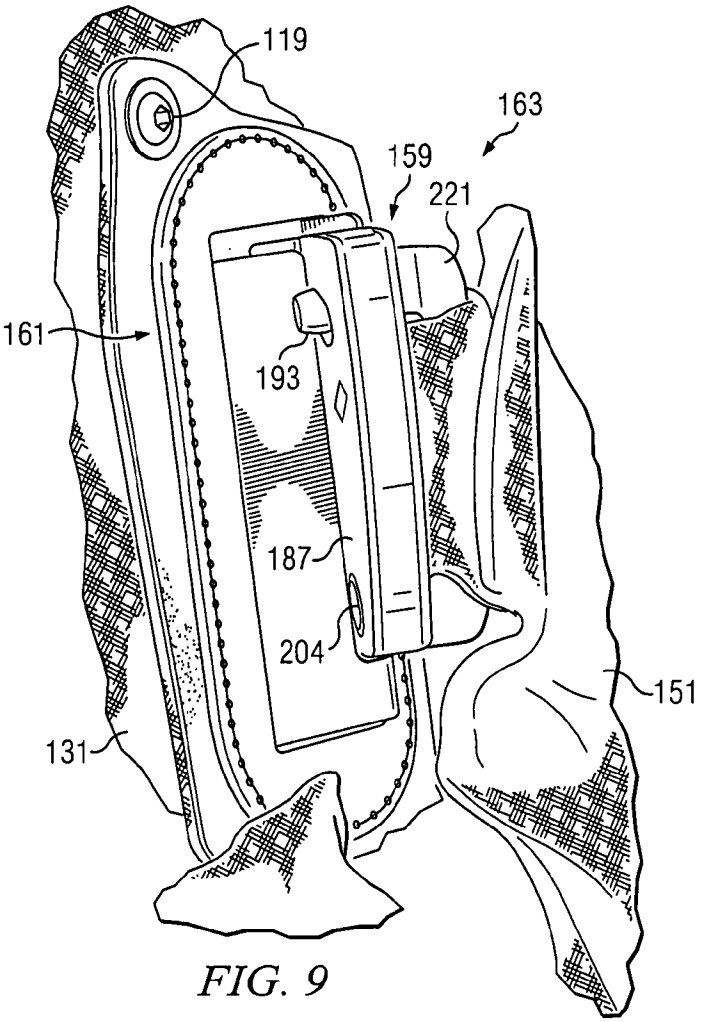
FIG. 9 is a side view of the male connector of FIG. 6*a* secured in the female connector of FIG. 8.

FIGS. 9 and 10 illustrate the example first fastener 163 being disassembled (i.e., the first child support connector 159 being removed from the second child support connector 161). In the illustrated example of FIGS. 1-5, the second fastener 169 is substantially the same as the first fastener 163. In the example of FIG. 9, the first child support connector 159 is fully coupled with the second child support connector 161. In this configuration, the lug 189 is fully inserted into the guide channel 195, and the latch 191 is positioned in the receptacle 197, as described above. To release the fastener 163, the handle 193 is actuated (i.e., moved in the direction of the arrow shown in FIG. 6*a*) to compress the spring 206, which draws the latch 191 further into the interior of the grip 187 toward the release position. As the latch 191 is pulled further into the grip 187, the latch 191 pulls out of the receptacle 197. Consequently, the latch 191 no longer secures the lug 189 of the first child support connector 159 from sliding relative to the channel 195 of the second child support connector 161. Thus, the first child support connector 159 may be slid upward relative to the second child support connector 161, as shown in FIG. 10. If the first child support connector 159 is moved sufficiently far, the first child support connector 159 can be separated from the second child support connector 161.

Figure 7:
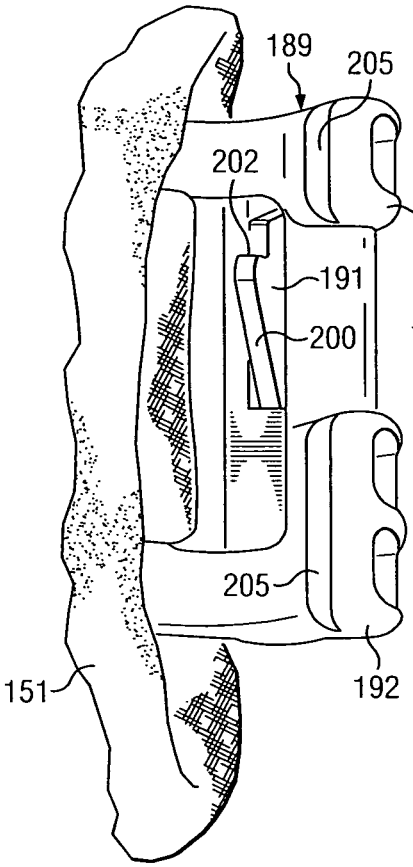
FIG. 7 is a side view of the child support connector of FIG. 6*a*.

To reassemble the fastener 163, the lug 189 of the first child support connector 159 is slid into the guide channel 195. As shown in FIG. 7, the latch 191 includes a cam surface 200 which is positioned to engage a wall 196*b* of the second child support connector 161 as the lug 181 is slid into the channel 195. This engagement cams the latch 191 into the grip 187 (i.e., away from the over-locked position) such that the latch 191 does not interfere with insertion of the first child support connector 159 into the second child support connector 161. Of course, the user may use the handle 193 to pull the latch 191 against the spring force and out of the latched position to facilitate the connection process, if desired.

Once the first child support connector 159 is fully inserted into the second child support connector 161, the latch 191 will be located adjacent to the receptacle 197. Therefore, the spring 206 forces the latch 191 into the receptacle 197 to fully secure the first child support connector 159 into the second child support connector 161. As shown in FIG. 7, the latch 191 includes a step or generally horizontal surface 202 to engage a counter-surface adjacent to the receptacle 197 to provide a firm engagement between the first and second child support connectors 159, 161. A portion of the cam surface 200 can serve as the surface to engage a wall adjacent to the receptacle 197 to hold the latch 191 against the spring force in the locked position between the over-locked position and the released position.

Figure 11:
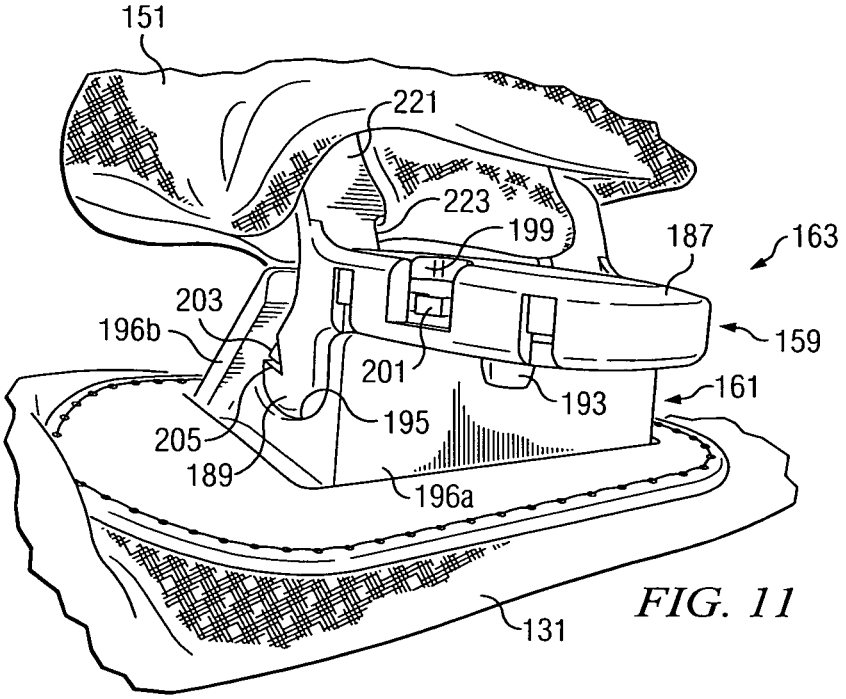
FIG. 11 is a perspective view of the example male connector and the example female connector of FIGS. 6*a*-10 in a locked state.
Figure 12:
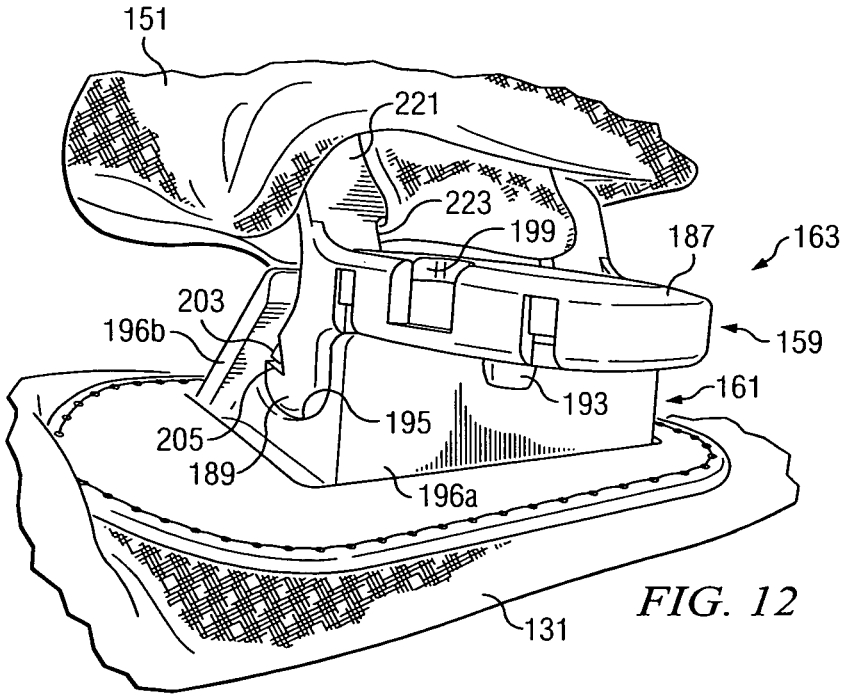
FIG. 12 is a view similar to FIG. 11, but showing the male connector and female connector in an unlocked state.

In the illustrated example, the grip 187 defines an indicator aperture 199 as shown in FIGS. 11 and 12. An indicator 201 associated with the latch 191 is visible through the aperture 199. In the illustrated example, the indicator 201 and aperture 199 are position such that when the latch 191 is in the locked position, the indicator 201 is at least partially exposed and visible in the aperture 199. In contrast, when the latch 191 is an unlocked position (i.e., not latched), the indicator 201 is not visible in the aperture 199. Thus, the wearer, or other person, can easily determine if the latch 191 is in the locked position or the unlocked position by glancing at the grip 187 to see if the indicator 201 is visible through the aperture 199. The indicator 201 may be brightly colored to enhance this visual recognition. This further safety feature allows the wearer to determine, at a glance, if the child support pouch 103 is secure and able to support a child.

Figure 6B:
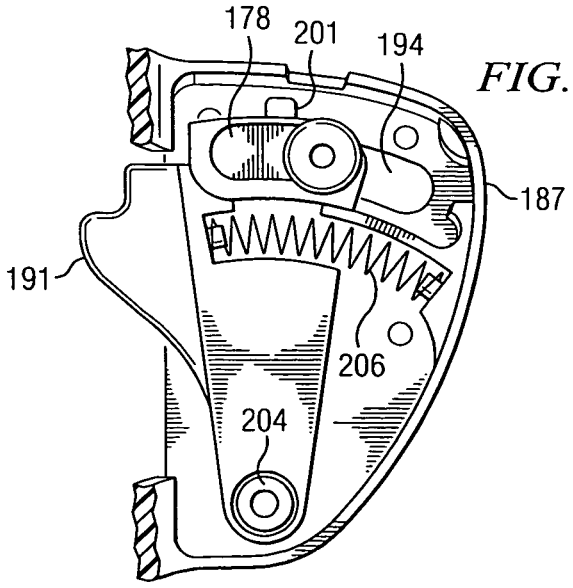
FIG. 6*b* is an exposed view showing the interior of the example male child support connector of FIG. 6*a*.

As mentioned above, the spring 206 biases the latch 191 toward the over-locked position (FIG. 6*b*). The latch 191 is in the over-locked position when the first child support connector 159 is not coupled to the second child support connector 161 and the user is not actuating the handle 193. As shown in FIG. 6*b*, in the over-locked position, the indicator 201 is not aligned with the aperture 199. This provides the same visual indication to the user that the first and second child support connectors 159, 161 are not secured, as described above. In other words, the indicator 201 has a first position on a first side of the window 199 when the latch 191 is in the over-locked position, a second position adjacent to or within the window 199 when the latch 191 is in the locked position, and a third position on a second side of the window 199 opposite the first side when the latch 191 is in the released position.

To transition from the over-locked position to the locked position, the first child support clip 159 is inserted into the second child support clip 161 so that the latch 191 engages the receptacle 197. As mentioned above, when the latch 191 is in the latched position, the spring 206 is partially compressed and the indicator 201 is aligned with the aperture 199 to indicate locked engagement between the first and second child support connectors 159, 161. To transition from the locked position to the unlocked position, the user actuates the handle 193 to traverse the slot 178 and the window 194. Once the handle 193 reaches the end of the slot 178 (i.e., the end of the lost motion path) and is pulled further in the direction of the arrows shown in FIG. 6*a*, the handle 193 engages the latch 191 and pulls the latch 191 along, out of the receptacle 197, thus moving the indicator 201 out of alignment with the aperture 199. The lost motion associated with moving the handle 193 from the locked position toward the released position is advantageous because it ensures accidental bumping of the handle 193 does not inadvertently move the latch 191 out of the locked position. Furthermore, the lost motion associated with the handle allows the user to insert the first child support clip 159 into the second child support clip 161 while the handle 193 is being restrained, i.e., if the user restrains movement of the handle 193 while grasping the first child support connector 159, the fastener 163 may still be formed because the latch 191 may move relative to the handle 193 by virtue of the slot 178.

In the example shown in FIGS. 11 and 12, the second child support connector 161 includes a projection 203 on the interior of the guide channel 195. The projection 203 interacts with a track 205 that is positioned along one side of the lug 189 of the first child support connector 159. Only when the projection 203 and the track 205 on the lug 189 are aligned will the first and second child support connectors 159, 161 be able to mate. In the illustrated example, the third and fourth child support connectors 165, 167 also have a projection and track structure (not shown), but the projection and track of the third and fourth child support connectors 165, 167 are preferably mirror images of the projection 203 and track 205 of the first and second child support connectors 159, 161. The projections 203 improve retention between the first and second child support connectors 159, 161 and the third and fourth child support connectors 165, 167, respectively.

Furthermore, there is a height differential between the walls 196*a* and 196*b* (i.e., wall 196*a* is taller than wall 196*b*). The height differential of the walls 196*a, b* requires a specific orientation of the child support connectors 159, 161, 165 and 167 before a secure connection can be made. As a result, the first child support connector 159 cannot mate with the fourth child support connector 167 and that the third child support connector 165 cannot mate with the second child support connector 161. Thus, the wearer cannot inadvertently twist the front portion 135 of the child support pouch 103 during assembly.

The illustrated example first child support connector 159 further includes an ear 221 that is joined in a Y-configuration with the grip 187 and the lug 189. The example ear 221 couples the first child support connector 159 to the child support pouch 103. In the illustrated example shown in FIG. 11, the ear 221 has a slot 223 through which a portion of the first wing 151 of the front portion 135 of the pouch 103 is threaded to secure the first child support connector 159 to the pouch 103. In an alternative example, the ear 221 may couple the first child support connector 159 to the harness 105 in a similar manner.

Figure 13:
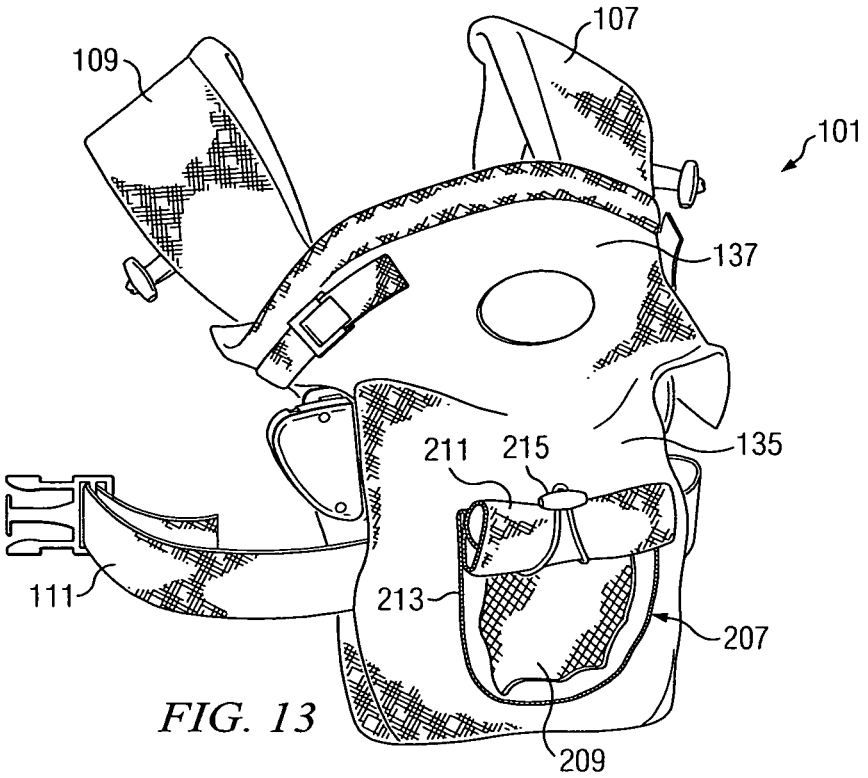
FIG. 13 is a perspective view of an example carrier with an example vent in an example open state.
Figure 14:
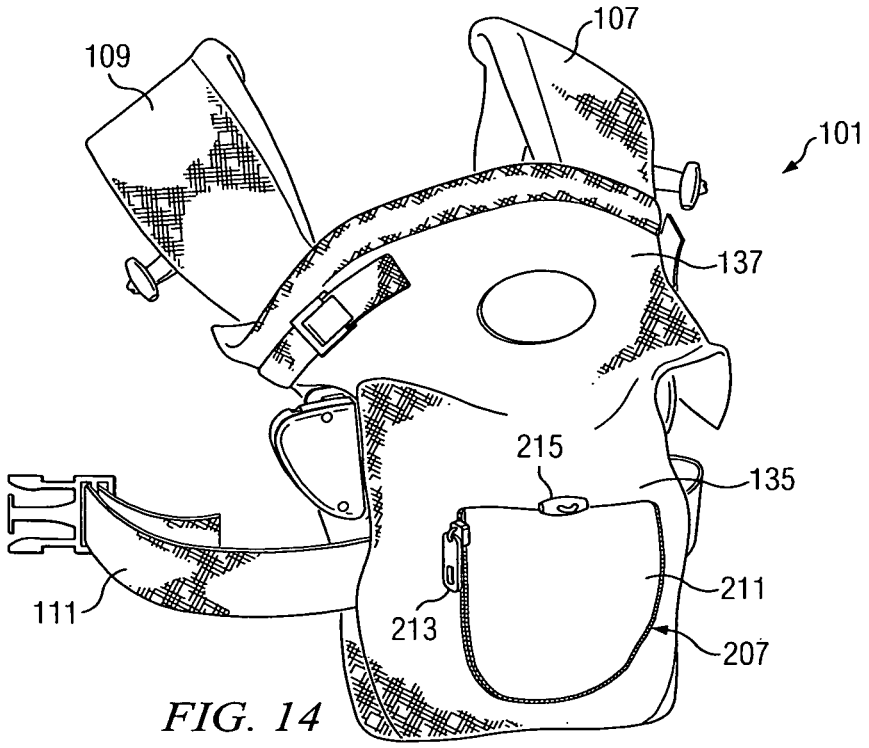
FIG. 14 is a perspective view of an example carrier with an example vent in an example closed state.

The illustrated example child carrier 101 also has a front vent 207. The vent 207 of the illustrated example has an open position (illustrating the example open position shown in FIG. 13). The vent 207 of the illustrated example also has a closed position (illustrating the example closed position shown in FIG. 14). The vent 207 includes a mesh screen 209 and a cover 211, which is at least partially removable to expose the mesh screen 209. To remove the cover 211, a closed fastener 213 is unfastened. In the illustrated example, a zipper is shown as the closed fastener 213, but any mechanical fastener may be used. Once the closed fastener 213 is unfastened, the cover 211 may be folded or rolled up to expose the mesh screen 209. The cover 211 may be secured in the folded or stored position by an open fastener 215. In the illustrated example, the open fastener 215 is shown as a toggle and loop, but any mechanical fastener may be used.

In the illustrated example, the back portion 131 includes a back vent 217 (See FIG. 5). The back vent 217 may also include a cover, though not specifically illustrated in FIG. 5. When open, the vents 207, 217 allow exterior air to reach the interior of the child support pouch 103. When closed, the vents 207, 217 help keep the child warm and dry.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A child carrier comprising:

a child support pouch to receive a child in a substantially upright position; and a harness to support the child support pouch on an adult, the harness including:

first and second support straps;

first and second waist straps;

first and second support strap connector pairs, the first support strap connector pair being located to releasably connect the first support strap to the first waist strap in a first orientation with the first support strap across a shoulder of the adult and to releasably connect the first support strap to the first waist strap in a second orientation with the first support strap around a waist of the adult, and the second support strap connector pair being located to releasably connect the second support strap to the second waist strap.

2. A child carrier as defined in claim 1 wherein the second support strap connector pair is located to releasably connect the second support strap to the second waist strap in a first orientation with the second support strap across a shoulder of the adult and to releasably connect the second support strap to the second waist strap in a second orientation with the second support strap around the waist of the adult.

3. A child carrier as defined in claim 1 wherein the first connector pair includes a first male connector and a first female connector and the second connector pair includes a second male connector and a second female connector, the first male connector being located on the first support strap, the first female connector being located on the first waist strap, the second female connector being located on the second support strap, the second male connector being located on the second waist strap.

4. A child carrier as defined in claim 1 wherein the first support strap is pivotably coupled to the child support pouch.

5. A child carrier as defined in claim 3 wherein the second support strap is pivotably coupled to the child support pouch.

6. A child carrier as defined in claim 1 wherein the child support pouch is located adjacent a front of the adult when the first support strap is in the first orientation and the child support pouch is located adjacent a side of the adult when the first support strap is in the second orientation.

7. A child carrier as defined in claim 1 wherein at least one of the first support strap and the first waist strap is adjustable.

8. A child carrier as defined in claim 1 wherein the child support pouch further includes:

a back to be positioned between a child in the child support pouch and the adult;

a bottom;

a front; and a headrest coupled to the front.

9. A child carrier as defined in claim 8 further including first and second headrest connector pairs to releasably connect the headrest to at least one of the back, the first support strap or the second support strap.

10. A child carrier as defined in claim 8 wherein the headrest is foldable between a support position and a storage position.

11. A child carrier as defined in claim 8 wherein the front includes a vent.

12. A child carrier as defined in claim 11 wherein the vent includes a mesh screen.

13. A child carrier as defined in claim 12 further including a cover which is at least partially removable to expose the mesh screen.

14. A child carrier as defined in claim 12 further including a cover fastener to secure the cover in a rolled or folded position to expose the mesh screen.

15. A child carrier as defined in claim 8 wherein the back includes a vent.

16. A child carrier as defined in claim 8 wherein the front defines first and second wings.

17. A child carrier as defined in claim 16 wherein the first and second wings cooperate with the headrest to define first and second arm openings.

18. A child carrier as defined in claim 16 further including:

a first child support connector associated with the first wing;

a second child support connector associated with the back of the child support pouch to mate with the first child support connector;

a third child support connector associated with the second wing; and a fourth child support connector associated with the back of the child support pouch to mate with the third child support connector.

19. A child carrier as defined in claim 18 wherein the child support pouch defines first and second leg openings when the first child support connector is coupled with the second child support connector and the third child support connector is coupled with the fourth child support connector.

20. A child carrier as defined in claim 19 further including a first leg opening connector to reduce a size of the first leg opening.

21. A child carrier as defined in claim 18 wherein one of the first or the second child support connectors includes:

a grip;

a lug extending from the grip to mate with the other of the first or the second child support connectors; and a latch having a locked position and a released position.

22. A child carrier as defined in claim 21, wherein the latch also has an over-locked position.

23. A child carrier as defined in claim 21 wherein the other of the first or the second child support connectors includes a receptacle to mate with the latch when the latch is in the locked position to secure the first and second child support connectors in releasable engagement.

24. A child carrier as defined in claim 22 further including a spring biasing the latch toward the over-locked position.

25. A child carrier as defined in claim 22 further including a handle coupled to the latch to facilitate actuation of the latch between the over-locked position, the locked position and the released position.

26. A child carrier as defined in claim 22 further including an indicator associated with the latch to provide a visual indication when the latch is in at least one of the over-locked position, the locked position or the released position.

27. A child carrier as defined in claim 26 wherein the grip defines an aperture at least partially exposing the indicator when the indicator is in the at least one of the over-locked position, the locked position, or the released position.

28. A child carrier as defined in claim 21 further including a projection associated with the lug to ensure the one of the first or second child support connectors does not mate with the third or fourth child support connectors.

29. A child carrier as defined in claim 8 wherein the bottom is adjustable to adjust a size of the child support pouch.

30. A child carrier as defined in claim 1 further including:

a fastener to secure the child support pouch to the harness, the fastener including:

a male connector including a lug; and a female connector including a guide channel to receive the lug;

a first one of the male connector and the female connector including a spring and a latch, the latch being movable between a latched position, a released position, and an over-locked position, the spring biasing the latch toward the over-locked position; and a second one of the male connector and the female connector including a receptacle to receive the latch to secure the male connector to the female connector when the lug is in the guide channel and the latch is in the latched position within the receptacle, the latch to enter the over-locked position under the influence of the spring when the latch is not in the receptacle and the latch to be prevented from entering the over-locked position when the latch is in the receptacle.

31. A child carrier as defined in claim 30, further including a handle to operatively engage the latch to move the latch from the latched position to the released position, wherein the handle is positioned to traverse a lost motion path before operatively engaging the latch to move the latch from the latched position to the released position.

* * * * *